US009896247B2

(12) United States Patent
Balkus

(10) Patent No.: US 9,896,247 B2
(45) Date of Patent: Feb. 20, 2018

(54) SELF-CLOSING FLIP-SPOUT CAP

(71) Applicant: The Boeing Company, Chicago, IL (US)

(72) Inventor: Jeffrey A. Balkus, Gig Harbor, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/166,891

(22) Filed: May 27, 2016

(65) Prior Publication Data

US 2017/0341828 A1 Nov. 30, 2017

(51) Int. Cl.

| | |
|---|---|
| ***B65D 47/06*** | (2006.01) |
| ***B65D 47/04*** | (2006.01) |
| ***B65D 1/02*** | (2006.01) |
| ***B65D 41/04*** | (2006.01) |

(52) U.S. Cl.

CPC ..... *B65D 47/046* (2013.01); *B65D 1/0246* (2013.01); *B65D 41/04* (2013.01)

(58) Field of Classification Search

CPC ..... B65D 47/20; B65D 47/2006; B65D 47/2012; B65D 47/2018; B65D 1/0246; B65D 2313/04; B65D 47/046; B65D 41/04

USPC ..... 222/536, 534, 517, 484, 538–563; 220/709, 200–380; 215/200–364

See application file for complete search history.

(56) References Cited

U.S. PATENT DOCUMENTS

| | | | | | |
|---|---|---|---|---|---|
| 3,655,103 | A * | 4/1972 | Hazard | B65D 55/02 | 222/530 |
| 3,853,250 | A * | 12/1974 | Alpern | B65D 47/0866 | 222/517 |
| 4,776,501 | A * | 10/1988 | Ostrowsky | B65D 47/2006 | 215/235 |
| 5,065,912 | A * | 11/1991 | Rosenthal | B65D 47/2006 | 222/517 |
| 5,205,424 | A * | 4/1993 | Gaspar | B65D 50/067 | 215/210 |
| 5,624,410 | A * | 4/1997 | Tsukada | A61M 39/20 | 220/230 |
| 5,894,965 | A * | 4/1999 | Robbins, III | G01F 11/261 | 222/444 |
| 7,172,101 | B2 * | 2/2007 | Find | A47J 41/0005 | 220/230 |
| 8,505,787 | B2 * | 8/2013 | Fox | B65D 47/061 | 220/230 |
| 8,631,977 | B2 * | 1/2014 | Feierabend | B29C 45/006 | 220/345.1 |
| 8,651,306 | B2 * | 2/2014 | Pai | B65D 39/00 | 215/306 |
| 2011/0198361 | A1 | 8/2011 | Chen | | |

* cited by examiner

*Primary Examiner* — Charles P Cheyney
(74) *Attorney, Agent, or Firm* — Walters & Wasylyna LLC

(57) ABSTRACT

A cap including a cap body and a spout hingedly connected to the cap body and moveable relative to the cap body between at least a first position and a second position, wherein the spout in magnetically biased to the first position.

20 Claims, 3 Drawing Sheets

SELF-CLOSING FLIP-SPOUT CAP

FIELD

This application relates to caps for containers, such as chemical bottles, and, more particularly, to self-closing caps.

BACKGROUND

In a laboratory environment, chemicals, such as organic solvents (e.g., acetone, methyl ethyl ketone and the like), are often stored in bottles, such as plastic bottles and glass bottles. Chemical bottles are relatively smaller and easier to handle as compared to larger chemical storage containers, such as can and drums, thereby providing laboratory personnel with ready access to chemicals.

For materials handling purposes, a chemical bottle is formed from a composition that is resistant to the chemical (or combination of chemicals) that will be contained within the bottle. Additionally, a chemical bottle typically includes a cap to contain chemical vapors within the bottle. Therefore, a properly capped chemical bottle may fully contain the chemicals stored therein.

In some laboratory environments, a particular chemical may be regularly used such that it becomes cumbersome for laboratory personnel to repeatedly open and close the same chemical bottle. Not surprisingly, such regularly used chemical bottles are often left open after use, such as with the cap completely removed from the chemical bottle (as in the case of a screw-on cap) or with the cap in the open configuration (as in the case of flip-top and flip-spout caps). Leaving chemical bottles open presents the risk of chemical vapors escaping from the chemical bottle into the ambient laboratory air.

Accordingly, those skilled in the art continue with research and development efforts directed to caps for containers, such as chemical bottles.

SUMMARY

In one embodiment, the disclosed cap may include a cap body and a spout hingedly connected to the cap body and moveable relative to the cap body between at least a first position and a second position, wherein the spout in magnetically biased to the first position.

In another embodiment, the disclosed cap may include a cap body including a lid portion and a barrel portion extending from the lid portion, the lid portion defining a fluid port, a spout including a spout body defining a fluid channel, the spout body being hingedly connected to the lid portion and moveable relative to the lid portion between at least a first position, wherein the fluid channel is fluidly decoupled from the fluid port, and a second position, wherein the fluid channel is fluidly coupled with the fluid port, and an attracting pair of magnets magnetically biasing the spout body to the first position.

Other embodiments of the disclosed self-closing cap will become apparent from the following detailed description, the accompanying drawings and the appended claims.

DETAILED DESCRIPTION

Disclosed is a self-closing cap that may be used to seal a container, such as a chemical bottle. The disclosed self-closing cap may employ magnets that magnetically bias the self-closing cap to a closed configuration. The self-closing cap may be opened by applying a force (e.g., manually) that is sufficient to overcome the biasing force of the magnets.

Figure 1:
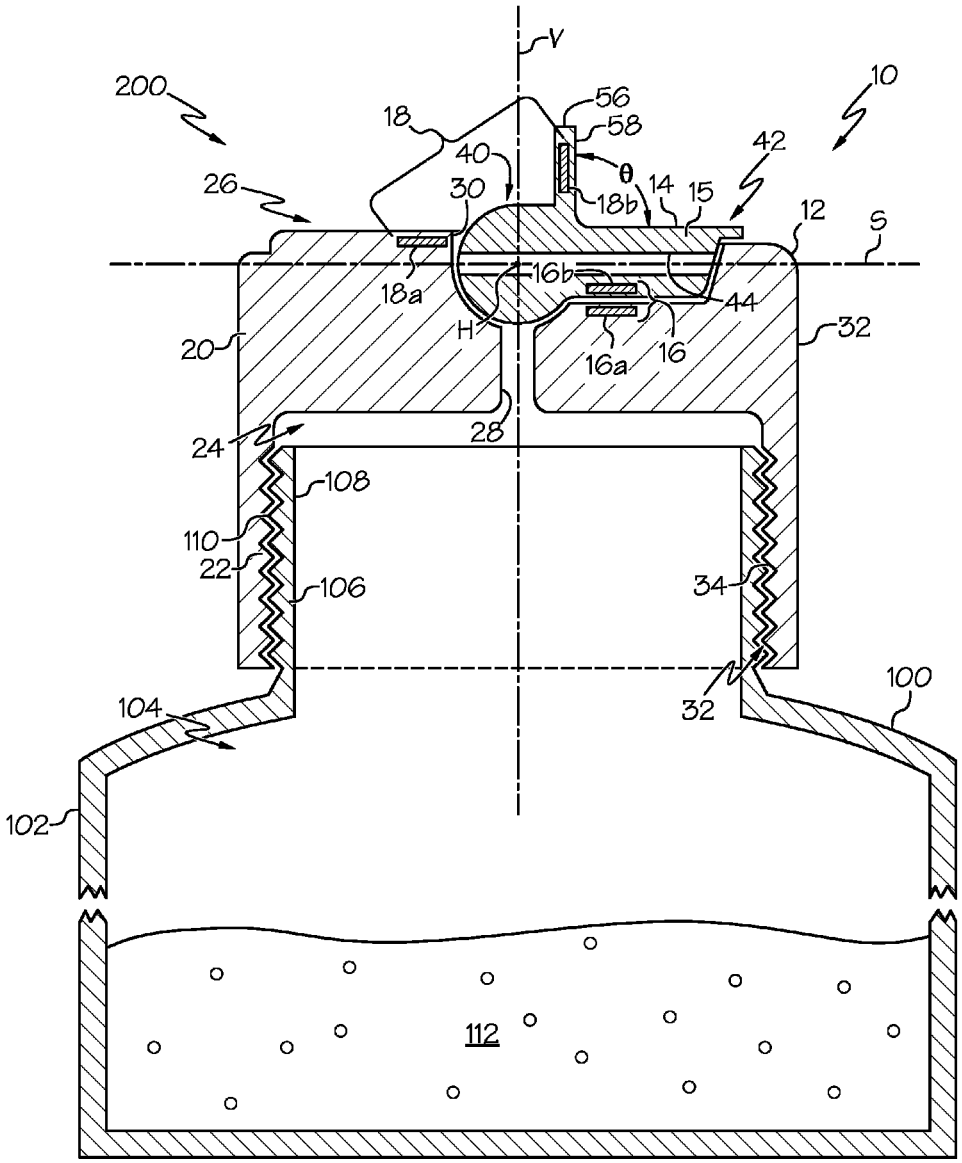
FIG. 1 is a side cross-sectional view of one embodiment of the disclosed self-closing cap, shown mounted on a container.
Figure 2:
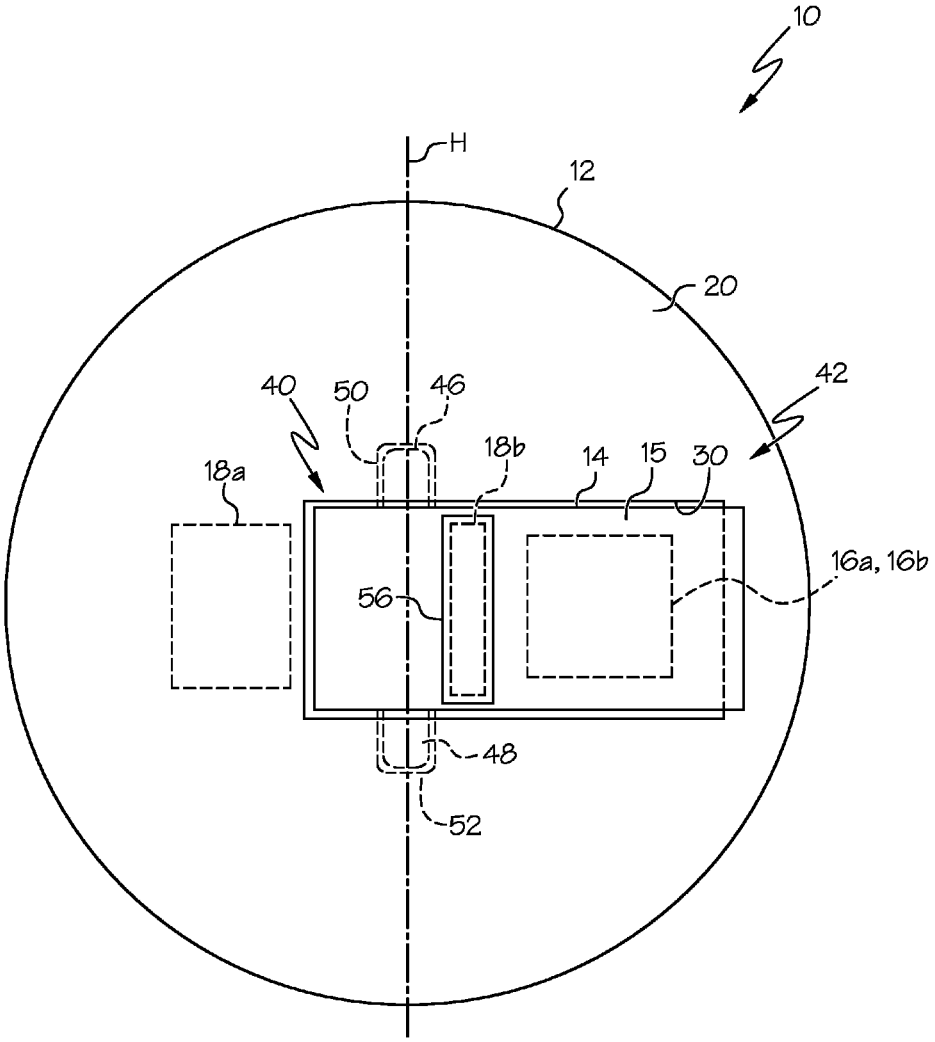
FIG. 2 is a top plan view of the self-closing cap of FIG. 1, shown without the container.
Figure 3:
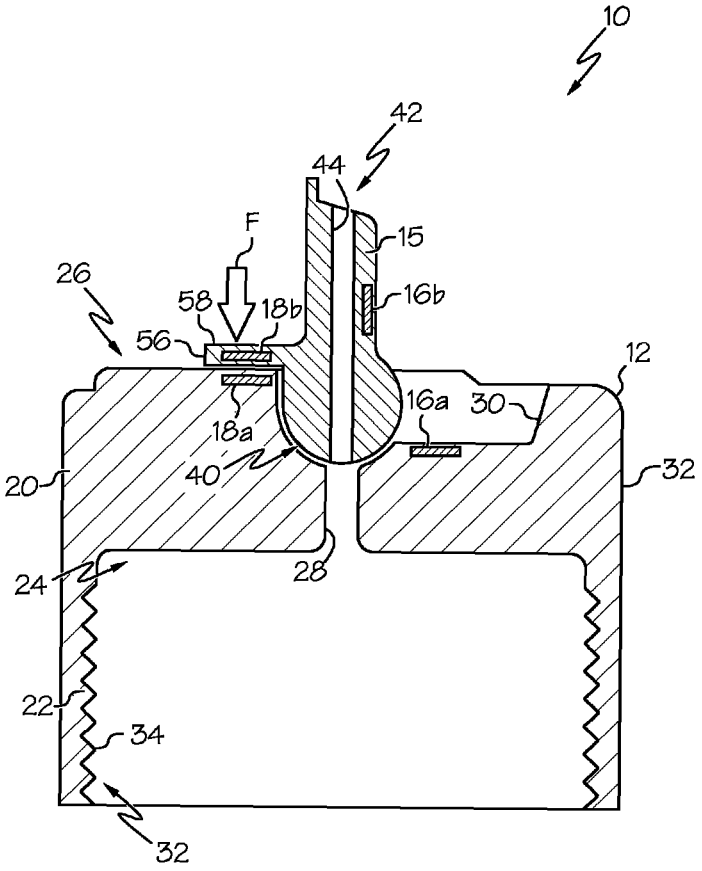
FIG. 3 is a side cross-sectional view of the self-closing cap of FIG. 1, but shown in an open configuration.

Referring to FIG. 1, one embodiment of the disclosed self-closing cap, generally designated 10, may include a cap body 12, a spout 14, an attracting pair 16 of magnets 16*a*, 16*b* and a repelling pair 18 of magnets 18*a*, 18*b*. The spout 14 may be hingedly connected to the cap body 12 and moveable relative to the cap body 12 between at least a first (closed) position, as shown in FIGS. 1 and 2, and a second (open) position, as shown in FIG. 3. The attracting pair 16 of magnets 16*a*, 16*b* and the repelling pair 18 of magnets 18*a*, 18*b* may magnetically bias the spout 14 to the first (closed) position.

The cap body 12 of the self-closing cap 10 may include a lid portion 20 and a barrel portion 22. The lid portion 20 of the cap body 12 may provide a sealing function, while the barrel portion 22 of the cap body 12 may provide a coupling function, as is described in greater detail herein.

The lid portion 20 of the cap body 12 may include an interior side 24 axially opposed (relative to a vertical axis V of the cap body 12) from an exterior side 26. The lid portion 20 may define a fluid port 28 extending between the interior side 24 and the exterior side 26, such as along the vertical axis V of the cap body 12. Additionally, the lid portion 20 may define a recess 30 on the exterior side 26, and the recess 30 may be sized and shaped to receive at least a portion of the spout 14 when the spout 14 is in the first (closed) position.

The barrel portion 22 of the cap body 12 may extend from the lid portion 20, such as from the interior side 24 of the lid portion 20 along the vertical axis V of the cap body 12. The barrel portion 22 may include one or more coupling features 32 to facilitate coupling the self-closing cap 10 with a container 100 to form a container assembly 200 that includes the container 100 and the self-closing cap 10.

In one particular realization, the container 100 may be a bottle, such as a glass or plastic bottle, and may include a container body 102 defining an internal volume 104 and a neck 106 defining an opening 108 into the internal volume 104. The neck 106 of the container 100 may include external threads 110. Therefore, the coupling feature 32 of the barrel portion 22 of the cap body 12 of the self-closing cap 10 may be (or may include) internal threads 34 configured to threadedly engage the external threads 110 on the neck 106 of the container 100.

A liquid 112 may be contained within the internal volume 104 of the container 100. Therefore, the container 100 may be sealed by threading the self-closing cap 10 onto the neck 106 of the container 100 (a threaded engagement), thereby containing within the container 100 any vapors associated with the liquid 112.

Compositionally, the cap body 12 of the self-closing cap 10 may be formed from various materials, including combinations of materials. The composition of the liquid 112 contained within the container 100 may be a factor in the selection of an appropriate composition for the cap body 12. As one general, non-limiting example, the cap body 12 may be formed from (or may include) a polymeric material. As one specific, non-limiting example, the cap body 12 may be formed from (or may include) low-density polyethylene (LDPE).

The spout 14 of the self-closing cap 10 may include a spout body 15 that is elongated along a spout axis S, and includes a proximal end portion 40 and a distal end portion 42 axially opposed from the proximal end portion 40 (relative to spout axis S). The spout body 15 may define a fluid channel 44 extending along the spout axis S from the proximal end portion 40 to the distal end portion 42.

As shown in FIG. 2, the proximal end portion 40 of the spout body 15 of the spout 14 of the self-closing cap 10 may be hingedly connected to the cap body 12 along a hinge axis H, thereby facilitating hinged movement of the spout 14 relative to the cap body 12 between at least the first (closed) position (FIGS. 1 and 2) and the second (open) position (FIG. 3). For example, protrusions 46, 48 may outwardly protrude from the proximal end portion 40 of the spout body 15 along the hinge axis H, and the protrusions 46, 48 may be received in corresponding recesses 50, 52 formed in the lid portion 20 of the cap body 12, thereby facilitating a hinged connection between the spout 14 and the cap body 12.

As best shown in FIG. 1, when the spout 14 is in the first (closed) position relative to the cap body 12, the fluid channel 44 of the spout body 15 may be isolated from the fluid port 28 of the cap body 12. Additionally, the fluid port 28 may be sealed by the proximal end portion 40 of the spout body 15. However, as best shown in FIG. 3, when the spout 14 is in the second (open) position relative to the cap body 12, the fluid channel 44 of the spout body 15 is fluidly coupled with the fluid port 28 of the cap body 12, thereby facilitating fluid communication with the internal volume 104 of the container 100 (when the self-closing cap 10 is mounted on the container 100). As such, liquid 112 in the container 100 may be expelled from the container 100 through the self-closing cap 10 when the spout 14 is in the second (open) position (FIG. 3).

Still referring to FIG. 1, the spout 14 of the self-closing cap 10 may further include an extension member 56 extending from the spout body 15. The extension member 56 may be integral with the spout body 15 (e.g., the spout body 15 and the extension member 56 may be a single monolithic body). As shown in the drawings, the extension member 56 may be generally normal to the spout body 15 (e.g., the angle θ between the extension member 56 and the spout axis S may be about 90 degrees), though it is contemplated that the extension member 56 may extend at various angles θ relative to the spout body 15.

Functionally, the extension member 56 may provide structure that facilitates manually engaging (e.g., with a finger) and moving the spout 14 relative to the cap body 12 between at least the first (closed) position (FIGS. 1 and 2) and the second (open) position (FIG. 3). For example, when a force F (FIG. 3) of sufficient magnitude is applied to the forward side 58 of the extension member 56, the force F may cause the spout body 15 to rotate about the hinge axis H (FIG. 2), thereby moving the spout 14 relative to the cap body 12 from the first (closed) position (FIG. 1) to the second (open) position (FIG. 3).

Compositionally, the spout 14 of the self-closing cap 10 may be formed from the same or similar materials as the cap body 12. The composition of the liquid 112 contained within the container 100 may be a factor in the selection of an appropriate composition for the spout 14. As one general, non-limiting example, the spout 14 may be formed from (or may include) a polymeric material. As one specific, non-limiting example, the spout 14 may be formed from (or may include) low-density polyethylene (LDPE).

The attracting pair 16 of magnets 16*a*, 16*b* and the repelling pair 18 of magnets 18*a*, 18*b* may magnetically bias the spout 14 to the first (closed) position, as shown in FIG. 1. While two pairs 16, 18 of magnets 16*a*, 16*b*, 18*a*, 18*b* are shown and described, it will be appreciated by those skilled in the art that this is only one particular implementation. In one alternative implementation, the disclosed self-closing cap 10 may include only the attracting pair 16 of magnets 16*a*, 16*b*. In another alternative implementation, the disclosed self-closing cap 10 may include only the repelling pair 18 of magnets 18*a*, 18*b*. In yet another implementation, the disclosed self-closing cap 10 may include magnets in addition to the two pairs 16, 18 of magnets 16*a*, 16*b*, 18*a*, 18*b* shown in the drawings.

The attracting pair 16 of magnets 16*a*, 16*b* of the self-closing cap 10 may be positioned and oriented to present to each other opposite polarities, thereby employing magnetic attraction to magnetically bias the spout 14 to the first (closed) position (FIG. 1). As shown in FIG. 1, magnet 16*a* may be connected to the lid portion 20 of the cap body 12 and may be oriented relative to magnet 16*b* to present a first polarity (e.g., north), while magnet 16*b* may be connected to the spout body 15 of the spout 14 and may be oriented relative to magnet 16*a* to present a second, opposite polarity (e.g., south). For example, the cap body 12 and the spout 14 may be formed from a polymeric material, and magnet 16*a* may be embedded in the polymeric material of the lid portion 20 of the cap body 12, while magnet 16*b* may be embedded in the polymeric material of the spout body 15 of the spout 14, though other techniques (e.g., adhesives, mechanical fasteners, press-fitting, etc.) for connecting the magnets 16*a*, 16*b* are also contemplated. Therefore, magnetic attraction between magnet 16*a* and magnet 16*b* may urge the spout 14 toward the cap body 12 and to the first (closed) position (FIG. 1).

The repelling pair 18 of magnets 18*a*, 18*b* of the self-closing cap 10 may be positioned and oriented to present to each other the same polarities, thereby employing magnetic repulsion to magnetically bias the spout 14 to the first (closed) position (FIG. 1). As shown in FIG. 1, magnet 18*a* may be connected to the lid portion 20 of the cap body 12 and may be oriented relative to magnet 18*b* to present a polarity (e.g., north), while magnet 18*b* may be connected to the extension member 56 of the spout 14 and may be oriented relative to magnet 18*a* to present the same polarity (e.g., north) as magnet 18*a*. For example, the cap body 12 and the spout 14 may be formed from a polymeric material, and magnet 18*a* may be embedded in the polymeric material of the lid portion 20 of the cap body 12, while magnet 18*b* may be embedded in the polymeric material of the extension member 56 of the spout 14, though other techniques (e.g., adhesives, mechanical fasteners, press-fitting, etc.) for connecting the magnets 18*a*, 18*b* are also contemplated. Therefore, magnetic repulsion between magnet 18*a* and magnet 18*b* may urge the extension member 56 of the spout 14 away from the cap body 12 and, thus, the spout 14 to the first (closed) position (FIG. 1).

Various magnetic materials, particularly permanent magnetic materials, may be used as (or in) the magnets 16*a*, 16*b*, 18*a*, 18*b*. For example, the magnets 16*a*, 16*b*, 18*a*, 18*b* may be (or may include) ferrite magnets or the like. However, when size is a consideration, the magnets 16*a*, 16*b*, 18*a*, 18*b* may be (or may include) rare-earth magnets, such as neodymium magnets.

Referring to FIG. 3, the spout 14 may be moved relative to the cap body 12 from the first (closed) position (FIG. 1) to the second (open) position (FIG. 3) by manually applying (e.g., with a user's finger) a force F to the spout 14, such as to the extension member 56 of the spout 14. The force F may have a magnitude sufficient to overcome both the attracting force of the attracting pair 16 of magnets 16*a*, 16*b* and the repelling force of the repelling pair 18 of magnets 18*a*, 18*b*. However, when the force F ceases to be applied, the attracting force of the attracting pair 16 of magnets 16*a*, 16*b* and the repelling force of the repelling pair 18 of magnets 18*a*, 18*b* may urge the spout 14 back to the first (closed) position (FIG. 1).

Accordingly, the disclosed self-closing cap 10 employs magnetism, such as magnetic attraction, magnetic repulsion or both, to be "self-closing" (biased to a closed configuration).

Although various embodiments of the disclosed self-closing cap have been shown and described, modifications may occur to those skilled in the art upon reading the specification. The present application includes such modifications and is limited only by the scope of the claims.

What is claimed is:

1. A cap comprising:

a cap body;

a spout hingedly connected to said cap body about a hinge axis and rotationally moveable relative to said cap body between at least a closed position and an opened position;

a first magnet connected to a portion of said cap body; and a second magnet connected to said spout at a portion thereof that rotates about said hinge axis towards and away from said portion of said cap body connected to said first magnet, wherein said spout is magnetically biased to said closed position.

2. The cap of claim 1 wherein said first magnet and said second magnet form an attracting pair.

3. The cap of claim 2 wherein at least one of said first magnet and said second magnet comprises a rare-earth magnet.

4. The cap of claim 2 further comprising a third magnet connected to said cap body and a fourth magnet connected to said spout, wherein said third magnet and said fourth magnet form a repelling pair.

5. The cap of claim 4 wherein at least one of said third magnet and said fourth magnet comprises a rare-earth magnet.

6. The cap of claim 4 wherein said spout comprises a spout body and an extension member extending from said spout body.

7. The cap of claim 6 wherein said second magnet is connected to said spout body and said fourth magnet is connected to said extension member.

8. The cap of claim 4 wherein said first magnet and said third magnet are embedded in said cap body, and wherein said second magnet and said fourth magnet are embedded in said spout.

9. The cap of claim 1 wherein said cap body comprises a lid portion that defines a fluid port.

10. The cap of claim 9 wherein said spout defines a fluid channel, and wherein said fluid channel is fluidly decoupled from said fluid port when said spout is in said opened position and fluidly coupled with said fluid port when said spout is in said closed position.

11. The cap of claim 9 wherein said lid portion further defines a recess, and wherein said spout is at least partially received in said recess when said spout is in said first position.

12. The cap of claim 9 wherein said cap body further comprises a barrel portion extending from said lid portion, said barrel portion comprising a coupling feature.

13. The cap of claim 12 wherein said coupling feature comprises internal threads.

14. The cap of claim 1 wherein at least one of said cap body and said spout comprises a polymeric material.

15. A container assembly comprising:

a container comprising a container body defining an internal volume and a neck defining an opening into said internal volume; and said cap of claim 1, in which said cap body is in engagement with said neck.

16. The container assembly of claim 15 wherein said engagement between said cap body and said neck is a threaded engagement.

17. A cap comprising:

a cap body comprising a lid portion and a barrel portion extending from said lid portion, said lid portion defining a fluid port;

a spout comprising a spout body including a proximal end portion and a distal end portion and defining a fluid channel extending from the proximal end portion to the distal end portion, said spout body being hingedly connected to said lid portion along a hinge axis disposed between the proximal end and the distal end of the fluid channel, said spout body being rotationally moveable relative to said lid portion between at least a closed position, wherein said fluid channel is fluidly decoupled from said fluid port, and an opened position, wherein said fluid channel is fluidly coupled with said fluid port; and an attracting pair of magnets magnetically biasing said spout body to said closed position, wherein a first magnet of said attracting pair of magnets is connected to said lid portion and a second magnet of said attracting pair of magnets is connected to said spout body at a portion thereof that rotates about said hinge axis towards and away from said lid portion.

18. The cap of claim 17 wherein said spout further comprises an extension member extending from said spout body.

19. The cap of claim 18 further comprising a repelling pair of magnets, wherein a first magnet of said repelling pair of magnets is connected to said lid portion and a second magnet of said repelling pair of magnets is connected to said extension member.

20. The cap of claim 18 wherein said extension member extends from said spout body in a radial direction with respect to said hinge axis.

* * * * *